US010278453B2

(12) United States Patent
Rietdyk

(10) Patent No.: US 10,278,453 B2
(45) Date of Patent: May 7, 2019

(54) SHOE WITH HEEL SLIDER FOR PILOTS

(71) Applicant: Guido Rietdyk, Rancho Dominguez, CA (US)

(72) Inventor: Guido Rietdyk, Rancho Dominguez, CA (US)

( * ) Notice: Subject to any disclaimer, the term of this patent is extended or adjusted under 35 U.S.C. 154(b) by 187 days.

(21) Appl. No.: 15/344,190

(22) Filed: Nov. 4, 2016

(65) Prior Publication Data

US 2018/0125164 A1 May 10, 2018

(51) Int. Cl.

| | |
|---|---|
| ***A43B 21/24*** | (2006.01) |
| ***A43B 21/02*** | (2006.01) |
| ***A43B 3/00*** | (2006.01) |
| ***A43B 13/04*** | (2006.01) |
| ***A43B 13/12*** | (2006.01) |
| ***A43B 13/14*** | (2006.01) |
| ***A43B 13/18*** | (2006.01) |
| ***A43B 21/54*** | (2006.01) |
| ***A43B 5/00*** | (2006.01) |
| ***A43B 13/37*** | (2006.01) |

(52) U.S. Cl.

CPC ..... *A43B 21/02* (2013.01); *A43B 3/0036* (2013.01); *A43B 5/007* (2013.01); *A43B 13/04* (2013.01); *A43B 13/122* (2013.01); *A43B 13/125* (2013.01); *A43B 13/14* (2013.01); *A43B 13/141* (2013.01); *A43B 13/181* (2013.01); *A43B 13/37* (2013.01); *A43B 21/24* (2013.01); *A43B 21/54* (2013.01)

(58) Field of Classification Search

CPC ..... A43B 21/02; A43B 21/24; A43B 3/0036; A43B 5/007; A43B 13/04; A43B 13/122; A43B 13/14; A43B 13/141; A43B 13/181; A43B 13/37

See application file for complete search history.

(56) References Cited

U.S. PATENT DOCUMENTS

| | | | | |
|---|---|---|---|---|
| 1,157,140 A | | 10/1915 | Anderson | |
| 3,028,689 A | | 4/1962 | Dassler | |
| 4,224,749 A | * | 9/1980 | Diaz-Cano | A43B 21/26 36/34 R |
| 4,459,764 A | * | 7/1984 | Beck | A43B 23/30 36/72 B |
| 5,560,126 A | | 10/1996 | Meschan et al. | |

(Continued)

FOREIGN PATENT DOCUMENTS

| | | |
|---|---|---|
| CN | 103099381 A | 5/2013 |
| FR | 3024645 A1 | 2/2016 |

OTHER PUBLICATIONS

European Search Report; dated Feb. 2, 2018; pp. 10.

*Primary Examiner* — Ted Kavanaugh
(74) *Attorney, Agent, or Firm* — Lowe Graham Jones PLLC

(57) ABSTRACT

A shoe includes a shoe upper and a sole coupled to the shoe upper and that includes a lower surface comprising a first material. A heel insert is embedded in a heel portion of the sole and includes a second material having a coefficient of friction less than a coefficient of friction of the first material, such as less than half. The heel insert may include projections made of a low-friction material such as nylon or UHMW whereas the sole is made from rubber. The projections may be embedded in a frame that seats within an inverted U-shaped channel defined by the sole.

10 Claims, 7 Drawing Sheets

(56) References Cited

U.S. PATENT DOCUMENTS

| | | | | |
|---|---|---|---|---|
| 5,699,628 | A | 12/1997 | Boatwalla | |
| 2004/0148797 | A1* | 8/2004 | Nelson, Jr. | A43B 5/005 36/8.3 |
| 2007/0079530 | A1* | 4/2007 | Fusco | A43B 5/06 36/129 |
| 2007/0107260 | A1* | 5/2007 | Pasternak | A43B 3/0042 36/39 |
| 2008/0134545 | A1* | 6/2008 | Suzuki | A43B 5/007 36/131 |
| 2017/0258179 | A1* | 9/2017 | Conant | A43B 13/148 |

* cited by examiner

SHOE WITH HEEL SLIDER FOR PILOTS

FIELD OF THE INVENTION

This application relates to footwear.

BACKGROUND OF THE INVENTION

In fixed-wing and rotating-wing aircraft, foot pedals are used to control the aircraft. In a fixed-wing aircraft, the foot pedals control the rudder. In a rotating-wing aircraft, the pedals control the anti-torque system, e.g. the tail rotor blade pitch, speed, or orientation.

The shoe disclosed herein is particularly suited for use by an aircraft pilot.

SUMMARY OF THE INVENTION

In one aspect of the invention, a shoe includes a shoe upper and a sole coupled to the shoe upper, and includes a lower surface comprising a first material, the sole and shoe upper defining a volume sized to receive a wearer's foot. A heel member is secured to a heel portion of the sole and includes a second material having a coefficient of friction less than a coefficient of friction of the first material.

In some embodiments, the first material has a first coefficient of friction and the second material has a second coefficient of friction, the second coefficient of friction being less than half of the first coefficient of friction.

In some embodiments, the second coefficient of friction is between 0.2 and 0.4 times the first coefficient of friction.

In some embodiments, the first material is rubber and the second material is at least one of nylon and an ultra-high molecular weight (UHMW) polymer.

In some embodiments, the heel member is positioned such that when the shoe is positioned on a flat surface, the heel member engages the flat surface only when the shoe is pivoted at least 10 degrees above the flat surface.

In some embodiments, the heel member is positioned such that when the shoe is positioned on a flat surface, the heel member engages the flat surface when the shoe is pivoted between 10 and 30 degrees above the flat surface.

In some embodiments, the heel member includes a heel insert embedded in the heel portion of shoe, and the heel insert projects outwardly from the heel portion of the sole.

In some embodiments, the sole includes first and second projections that project upwardly from a lower surface of the sole at the ball of a wearer's foot.

In some embodiments, the sole defines an inverted U-shaped channel in the heel portion and the heel insert protrudes from inside the shoe out of the U-shaped channel.

In some embodiments, the heel insert comprises a flange positioned in the shoe and one or more protrusions secured to the flange, the protrusions extending through the U-shaped channel.

A method of use is also disclosed and claimed herein.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1A:
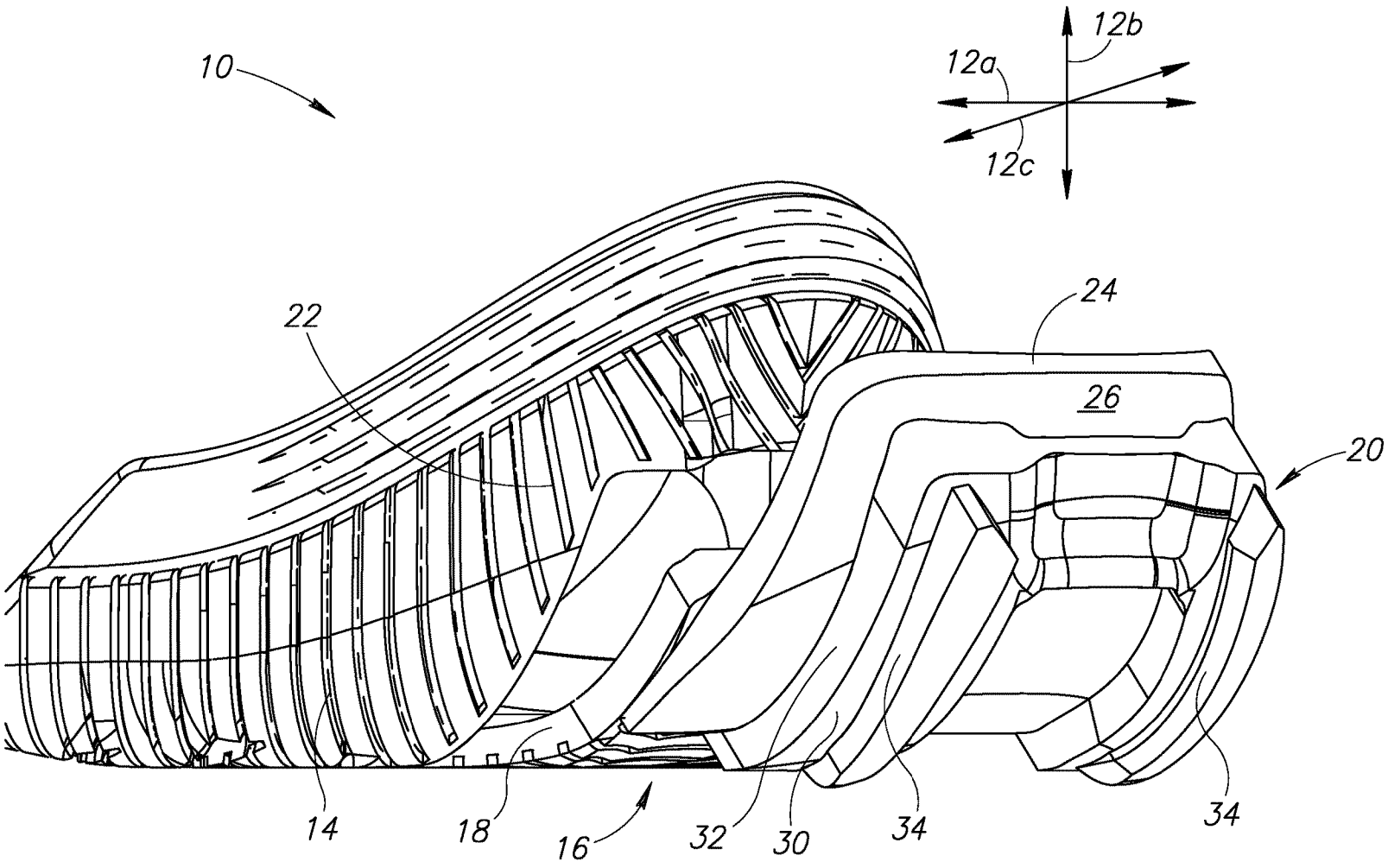
FIGS. 1A and 1B are partially exploded isometric views of a shoe incorporating a heel slider in accordance with an embodiment of the present invention.
Figure 1B:
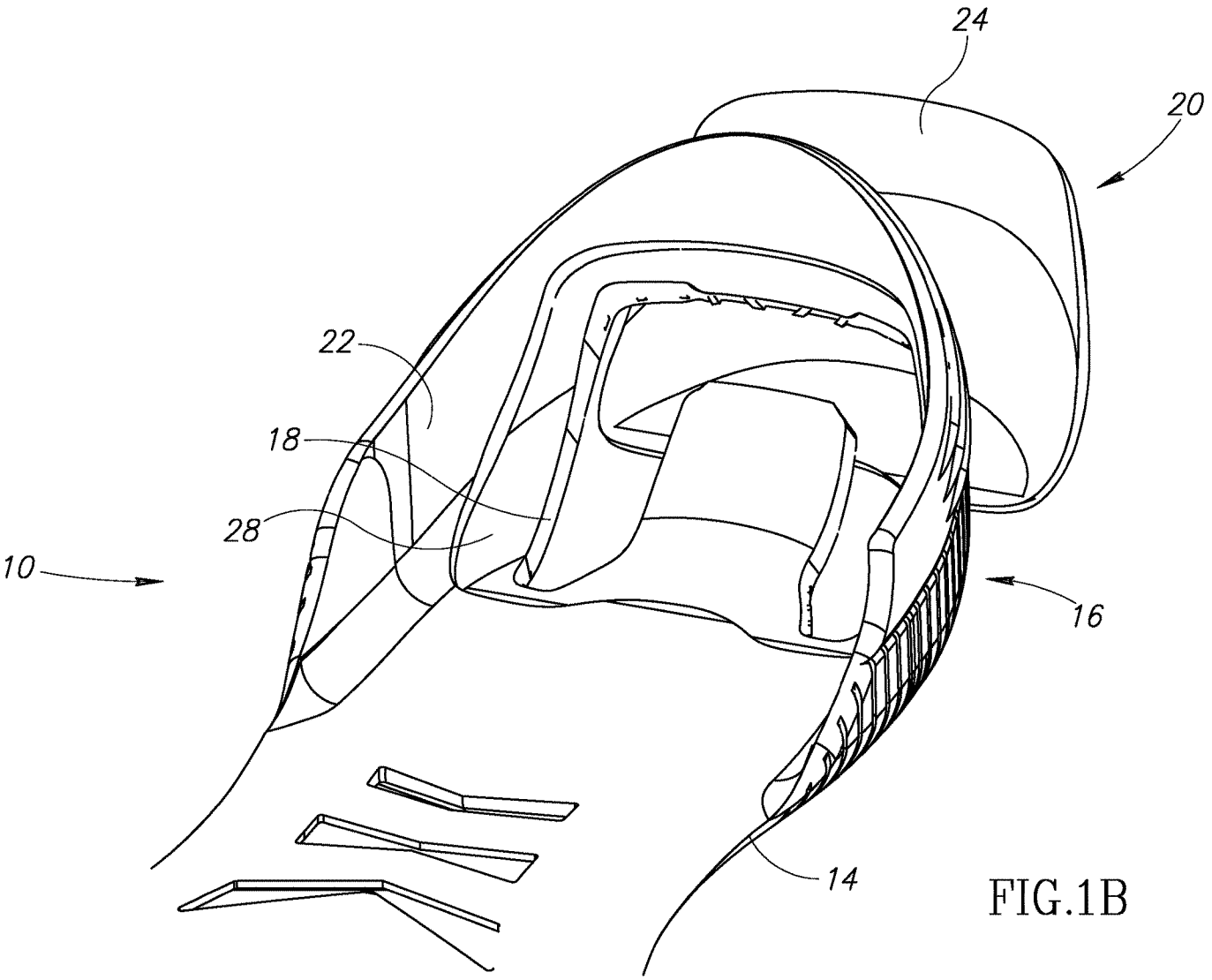

Referring to FIGS. 1A and 1B, a shoe 10 may be defined with respect to a longitudinal direction 12*a* corresponding to the heel-to-toe direction and the longest dimension of the shoe 10. A vertical direction 12*b* may be defined as orthogonal to a flat surface on which a sole 14 rests when a wearer is standing on the flat surface. A lateral direction 12*c* may be defined as perpendicular to the longitudinal and vertical directions 12*a*, 12*b*.

A heel 16 of the sole 14 defines a heel aperture 18 that receives a heel insert 20. As described in greater detail below, the heel insert 20 provides a low-friction surface for sliding on the floor of an aircraft cockpit to facilitate actuation of pedals. In alternate embodiments, a heel member may be secured to the heel portion of the shoe rather than inserted therein. For example, a puck made of a material with a lower friction coefficient is secured to the heel of a shoe. The puck or member may be metal, plastic, rubber, or other material.

In the illustrated embodiment, the heel aperture 18 is an inverted U-shaped aperture. The sole 14 defines a heel cup 22 that defines a concave inner surface for cradling the heel of a wearer and defines a wall extending upwardly from the lowest surface of the sole 14. The heel aperture 18 may be defined in a rear surface of the sole 14 and extend through the heel cup 22. The heel aperture 18 has an extent in the vertical direction 12 and may be positioned entirely above a lowermost surface of the sole 14.

The heel insert 20 may include an interior flange 24 that is positioned within the heel cup 22 of the shoe 10 when installed. Specifically, a surface 26 of the flange 24 may be adhered to an interior recessed surface 28 defined by the sole 14. The surface 26 of the flange 24 may be adhered to the interior recessed surface 28 by means of glue, ultrasonic welding, molding of the sole 14 around the heel insert 20, or any other adhesion process.

The heel insert 20 may include a frame portion 30 that has a shape corresponding to the heel aperture 18, e.g., an inverted U shape. The frame 30 may be sized to occupy the aperture 18 such that a perimeter surface 32 of the frame 30 engages the aperture 18. The perimeter surface 32 may be adhered to the aperture 18 by means of glue, ultrasonic welding, or molding of the sole 14 around the heel insert 20, or any other adhesion process.

The heel insert 20 further defines protrusions 34 that protrude outwardly from the frame 30 and outwardly from the sole 14 when the heel insert 20 is in place within the aperture 18. The protrusions 34 may be embedded in the frame 30 and may further extend into the layer of material defining the interior flange 24. The protrusions 34 may be made of the same or different material as the interior flange 24 and frame 30. Likewise, the interior flange 24 and frame 30 may be made of the same or different material. In some embodiments, the protrusions 34 may be made of a rigid, low-friction material such as nylon or an ultra-high molecular weight (UHMW) polymer. Other materials are alternatively used including metal, hard rubber, or plastic. The interior flange 24, frame 30, and the sole 14 may be formed of a wear resistant, flexible material such as a natural or synthetic rubber. For example, the interior flange 24, frame 30, and sole 14 may include polyurethane, a thermoplastic rubber, VIBRAM® rubber, or the like.

The protrusions 34 may secure to the frame 30 by means of glue, ultrasonic welding, molding of the frame 30 around the protrusions 34, or any other adhesion process. In some embodiments, the protrusions 34 and frame 30 may be formed by means of a two-shot molding process using the same or different materials for the protrusions 34 and frame 30.

In some embodiments, one or both of the interior flange 24 and frame 30 may have a hardness that is intermediate that of the sole 14 and the protrusions 34. The protrusions 34 may have a coefficient of friction that is much less than that of the sole 14. For example, the protrusions 34 may have a coefficient of friction that is less than half that of the sole 14. For example, the coefficient of friction of the protrusions 34 may be equal to from 0.2 to 0.4 times that of the sole 14.

The protrusions 34 are elongate having their long dimension oriented generally parallel (e.g. within 10 degrees of parallel) to a plane parallel to the longitudinal direction 12*a* and the vertical direction 12*b* when fastened to the sole 14. The protrusions 34 may also be radiused slightly in this plane, e.g. a radius of curvature of between 0.3 and 0.6 meters. The protrusions 34 may have a similar radius in a plane parallel to the longitudinal and lateral directions 12*a*, 12*c*.

The protrusions 34 are offset from one another along the lateral direction 12*c*. For example, a minimum separation between the surfaces of the protrusions 34 facing one another may be between 0.2 and 0.5 times the largest width of the sole 14 in the lateral direction 12*c*.

The protrusions 34 may be parallel to one another or may be angled outwardly or inwardly from one another with distance from the bottom of the sole 14 in a plane parallel to the vertical and lateral directions 12*b*, 12*c*, for example between 0 and 10 degrees.

The extent of the protrusions 34 in the vertical direction 12*a*, any curvature of the protrusions 34, and the separation of the protrusions 34 in the lateral direction 12*c* provides for a wide range of angles at which the protrusions 34 engage a supporting surface when the sole 14 is tilted upward during use, as described below with respect to FIGS. 4A and 4B.

Figure 2:
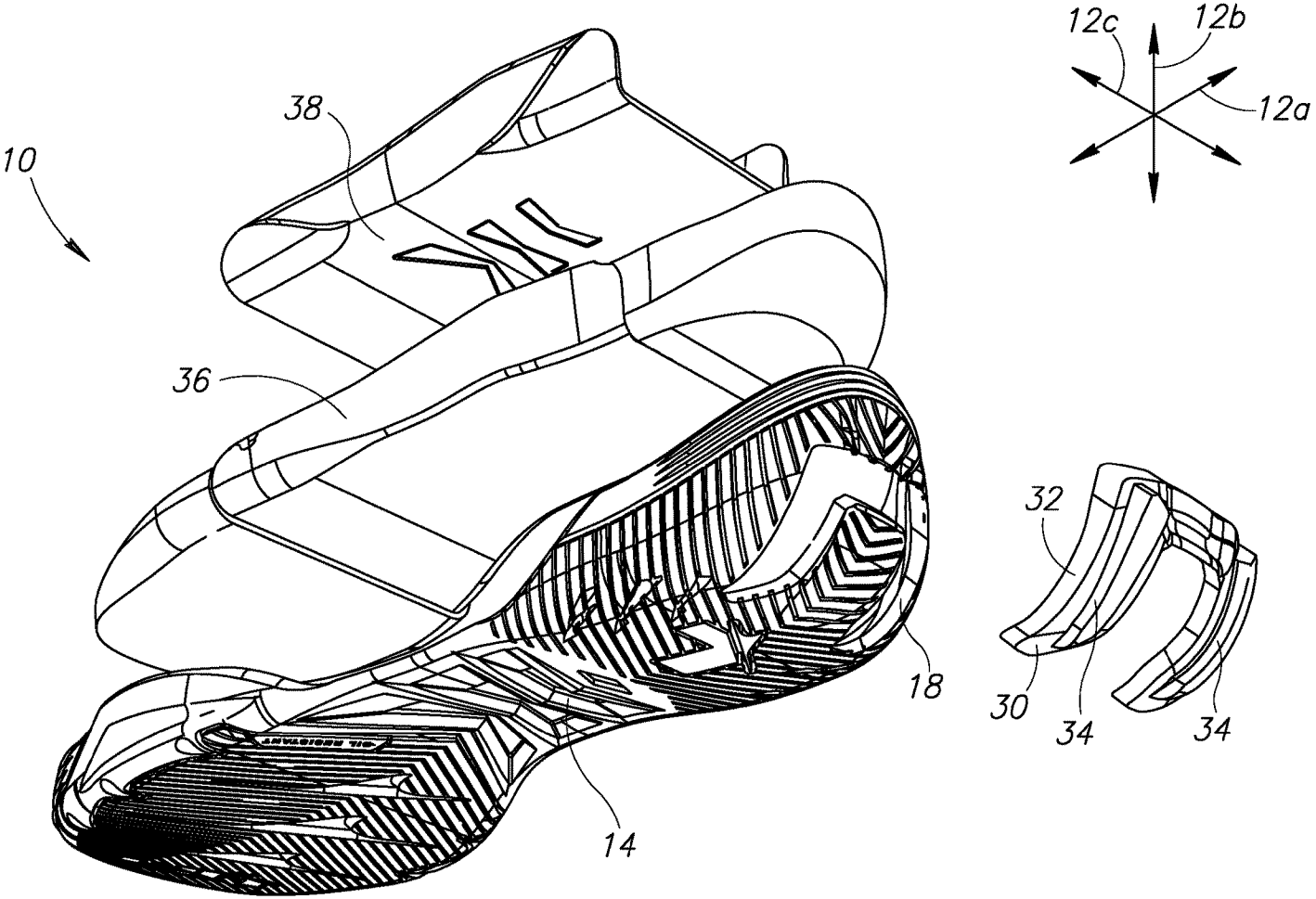
FIG. 2 is an exploded isometric view of a shoe incorporating an alternative embodiment of a heel slider in accordance with an embodiment of the present invention.

Referring to FIG. 2, in an alternative embodiment, the interior flange 24 is omitted from the heel insert 20. The corresponding recessed surface 28 may also be omitted from the sole 14 in such embodiments. In the embodiment of FIG. 2, molding of the sole 14 around the frame 30 may be the exclusive means of securement of the heel insert 20 to the sole 14. Alternatively, some other adhesion process may be used to secure the frame 30 within the aperture 18 in the sole 14 as outlined above.

FIG. 2 also shows a midsole 36 that is positioned on top of the sole 14 within the shoe 10. As known in the art, the midsole 36 may be a soft padding layer that provides comfort to the wearer. The interior flange 34 of FIGS. 1A and 1B may be flush with an interior surface of the sole 14 such that deformation or a recess in the midsole 36 is not required to accommodate the interior flange 34. In the embodiment of FIG. 2, a midsole support 38 also secures to a midsole portion of the sole 14 either above the midsole 36 or between the midsole 36 and the sole 14. In some embodiments, portions of the midsole support 38 may be exposed when the sole 14 is fastened to a shoe upper.

Figure 3:
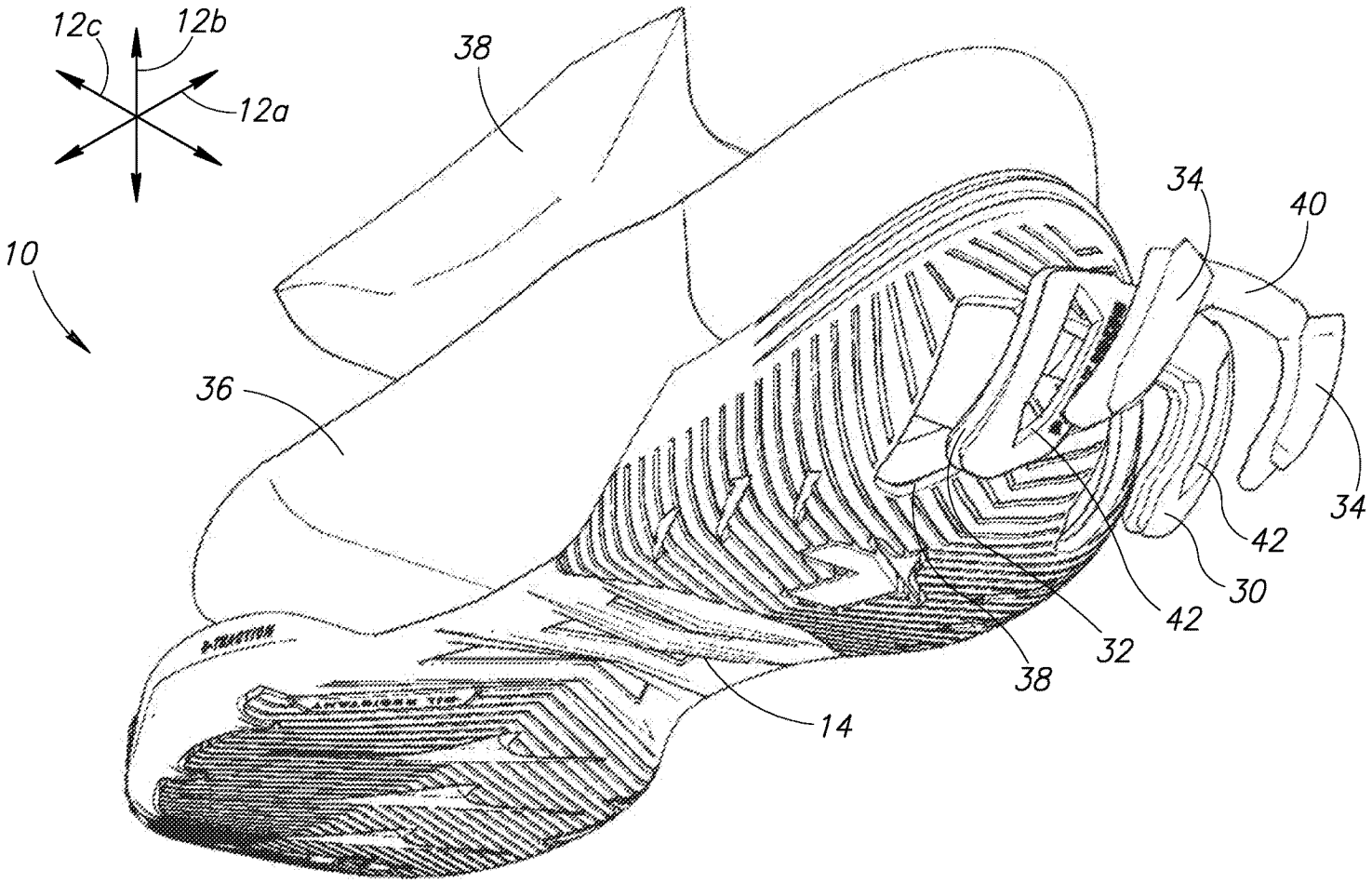
FIG. 3 is an exploded isometric view of a shoe incorporating yet another embodiment of a heel slider in accordance with an embodiment of the present invention.

Referring to FIG. 3, in yet another alternative embodiment, the protrusions 34 are formed on a protrusion frame 40 that is embedded or inserted into the frame 30. The protrusions 34 and protrusion frame 40 may be molded as single monolithic member or molded as separate pieces. In some embodiments, the protrusions 34 and protrusion frame 40 as shown in FIG. 3 may be embedded in the frame 30 and interior flange 34 shown in the embodiments of FIGS. 1A and 1B and FIG. 2. As shown the protrusion frame 40 may be have a narrower inverted U shape that is sized to fit within the inverted U shape of the frame 30. As shown the frame 30 defines apertures through which the protrusions 34 extend.

The frame 30 may be molded around the protrusions 34 and protrusion frame 40 or the protrusions 34 and protrusion frame 40 may insert within a previously molded frame 30. Likewise, the sole 14 may be molded around the frame 30 or the frame 30 may be adhered within a previously molded sole 14 as outlined above. In some embodiments, the frame 30 may have a perimeter surface 32 having a groove or ridge in order to more securely engage the sole 14.

Figure 4A:
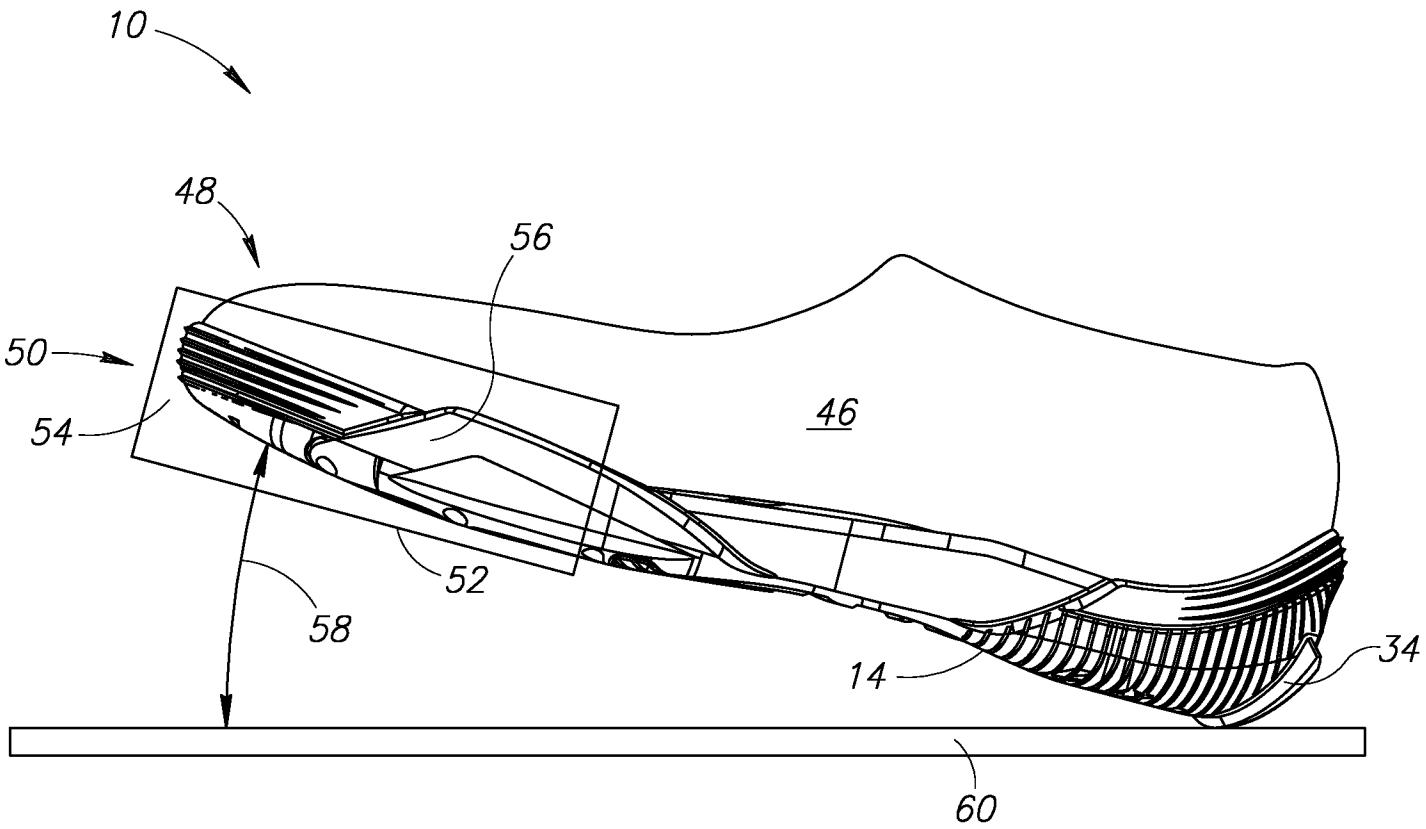
FIGS. 4A and 4B are side views illustrating use of shoes with an aircraft pedal in accordance with an embodiment of the present invention.
Figure 4B:
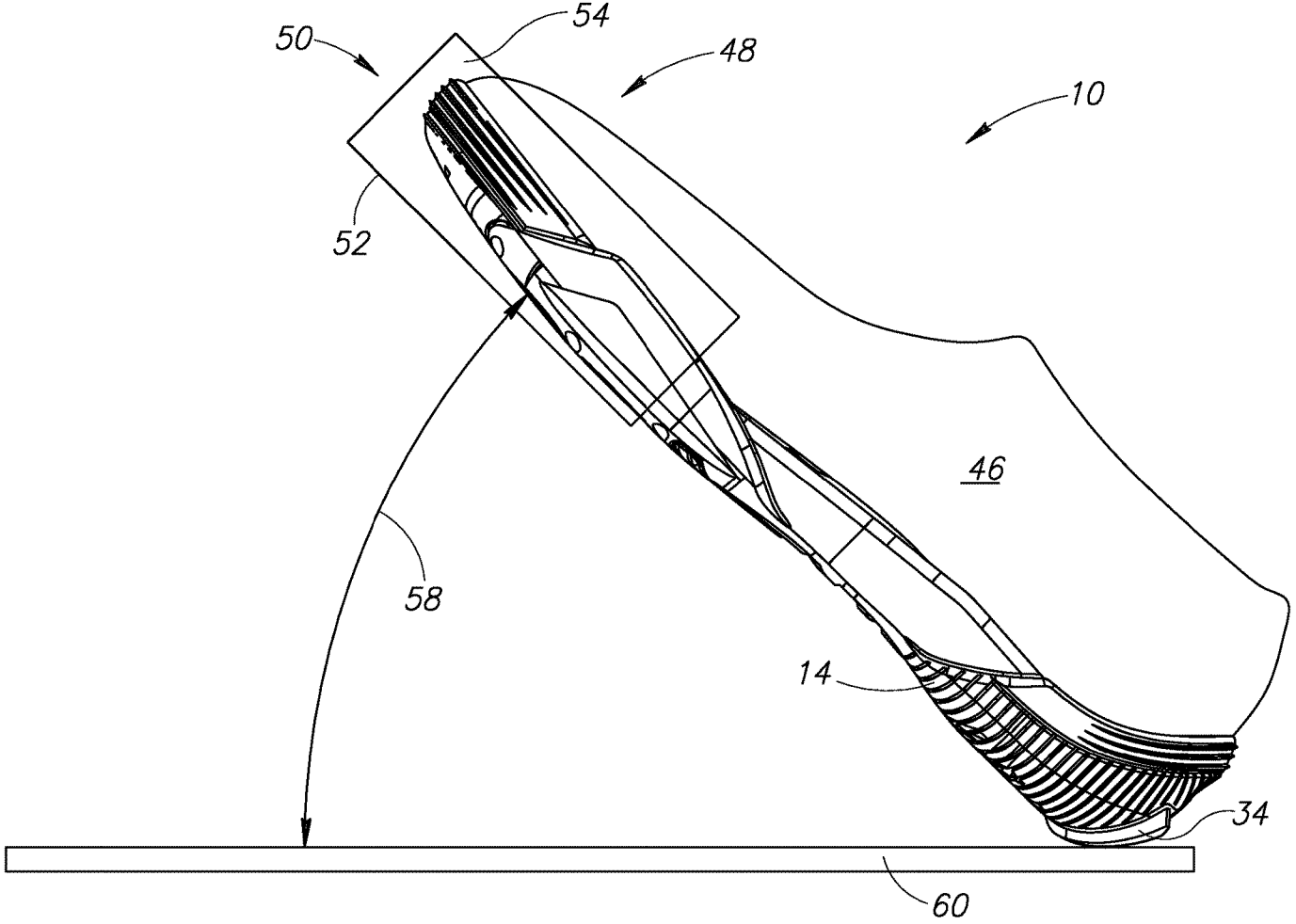

Referring to FIGS. 4A and 4B, a shoe upper 46 secures to the sole 14 in the conventional manner and the shoe 10 may be worn by a pilot of an aircraft. In use, a toe portion 48 of the shoe engages a pedal 50 of an aircraft. The pedal may define a lower surface 52 on which the sole 14 rests and a sidewall 54 that may extend upwardly from the lower surface 52 to the right, left, and/or in front of the toe portion 48 of the shoe. In some embodiments, the sole 14 may define mid-sole projections 56 that extend upwardly from the bottom surface of the sole 14 around the ball of the wearer's foot and engage the sidewall 54 in order to prevent premature wearing out of the shoe upper 46.

The longitudinal direction 12*a* of the shoe 10 defines an angle 58 with respect to a floor 60 during use. As shown in FIG. 4B, this angle 58 may change during operation as the pedal is actuated. As shown in FIGS. 4A and 4B, the protrusions 34 make contact with the floor 60 for a range of angles 58. For example, the protrusions 34 may make contact with the floor 60 for angles 58 from 10 to 30 degrees in some embodiments and from 0 to 45 degrees in others. In some embodiments, the protrusions 34 may be positioned above a lowest surface of the sole 14 such that during normal walking movement on a level surface, the protrusions 34 do not contact the ground. For example, the protrusions 34 may be positioned such that they contact a support surface only for angles 58 greater than 10 degrees.

Figure 5:
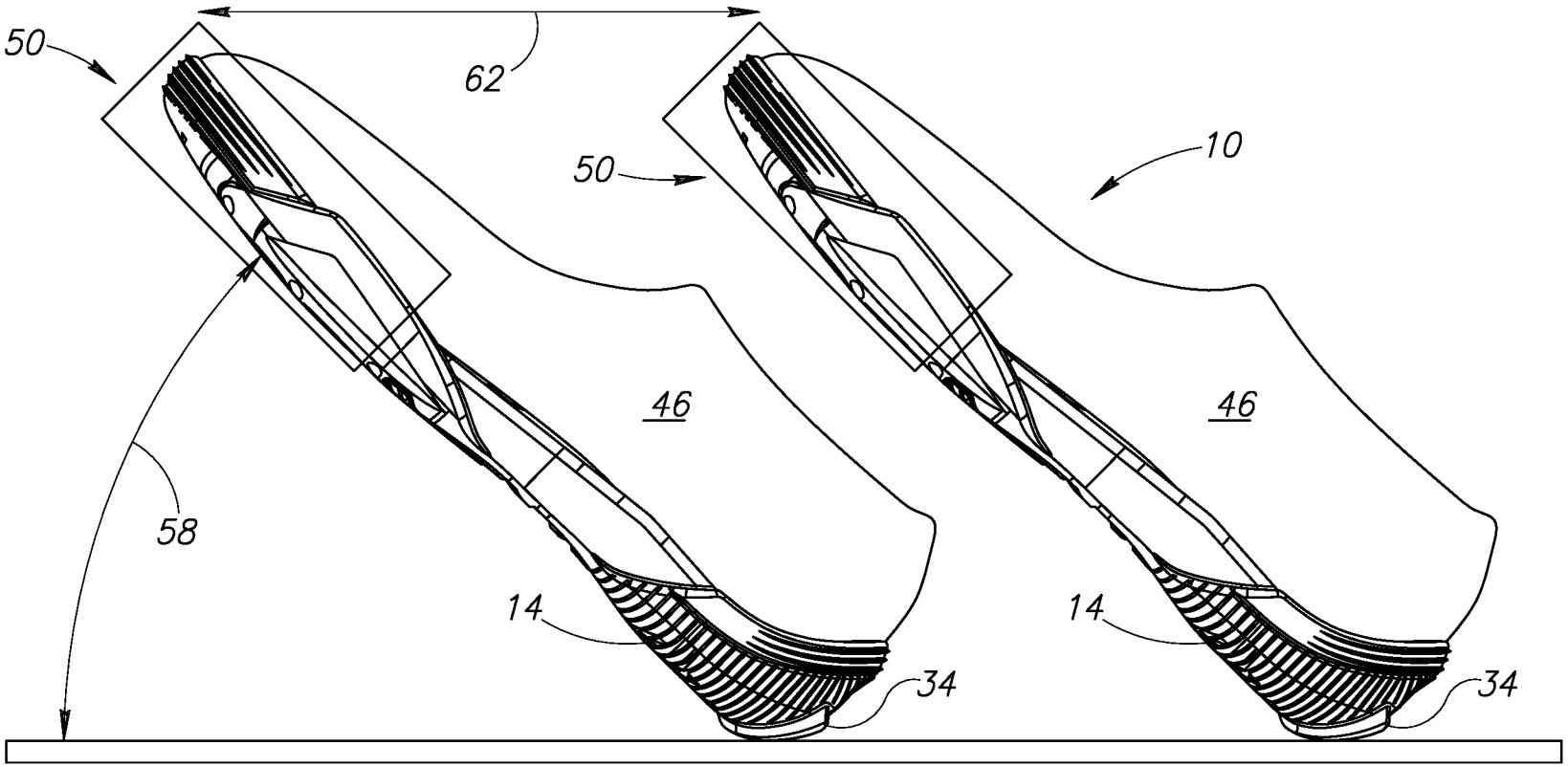
FIG. 5 is a side view illustrating sliding of a shoe in accordance with an embodiment of the present invention.

Referring to FIG. 5, during use, as the pilot actuates the pedal 50, the shoe 10 translates a distance 62 along the floor 60 while at an angle 58 or moving through a range of angles 58 with respect to the floor 60. In many aircraft, the floor 60 around the pedals 50 is covered in a steel plate or other low friction material. Accordingly, the combination of the steel plate and the low friction material of the protrusions 34 enables low friction sliding movement of the shoe 10 during actuation of the pedal 50.

While preferred embodiments of the invention have been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A shoe comprising:

a shoe upper;

a sole coupled to the shoe upper and comprising a lower surface comprising a first material, the sole and shoe upper defining a volume sized to receive a wearer's foot; and a heel member secured to a heel portion of the sole and comprising a second material having a coefficient of friction less than a coefficient of friction of the first material;

wherein the heel member includes a heel insert embedded in the heel portion of shoe, and wherein the sole defines a channel in the heel portion and the heel insert protrudes out of the channel.

2. The shoe of claim 1, wherein the first material has a first coefficient of friction and the second material has a second coefficient of friction, the second coefficient of friction being less than half of the first coefficient of friction.

3. The shoe of claim 2, wherein the second coefficient of friction is between 0.2 and 0.4 times the first coefficient of friction.

4. The shoe of claim 1, wherein the first material is rubber.

5. The shoe of claim 1, wherein the second material is at least one of nylon and an ultra-high molecular weight polymer.

6. The shoe of claim 1, wherein the heel member is positioned such that when the shoe is positioned on a flat surface, the heel member engages the flat surface only when the shoe is pivoted at least 10 degrees above the flat surface.

7. The shoe of claim 1, wherein the heel member is positioned such that when the shoe is positioned on a flat surface, the heel member engages the flat surface when the shoe is pivoted between 10 and 30 degrees above the flat surface.

8. The shoe of claim 1, further comprising first and second projections that project upwardly from a lower surface of the sole and adapted to be located at the ball of a wearer's foot.

9. A shoe comprising:

a shoe upper;

a sole coupled to the shoe upper and comprising a lower surface comprising a first material, the sole and shoe upper defining a volume sized to receive a wearer's foot; and a heel member secured to a heel portion of the sole and comprising a second material having a coefficient of friction less than a coefficient of friction of the first material;

wherein the heel member includes a heel insert embedded in the heel portion of shoe, and wherein the sole defines an inverted U-shaped channel in the heel portion and the heel insert protrudes from inside the shoe out of the U-shaped channel.

10. The shoe of claim 9, wherein the heel insert comprises a flange positioned in the shoe and one or more protrusions secured to the flange, the protrusions extending through the U-shaped channel.

* * * * *